US006135805A

United States Patent [19]

Sowinski

[11] Patent Number: 6,135,805

[45] Date of Patent: Oct. 24, 2000

[54] INSULATION DISPLACEMENT DEVICE FOR WIRE TERMINATION

[75] Inventor: Leonard A. Sowinski, Chicago, Ill.

[73] Assignee: Mandex Manufacturing Corporation, Chicago, Ill.

[21] Appl. No.: 09/128,702

[22] Filed: Aug. 4, 1998

[51] Int. Cl.[7] ..... H01R 4/24

[52] U.S. Cl. ..... 439/402; 439/417

[58] Field of Search ..... 439/395–417, 439/885

[56] References Cited

U.S. PATENT DOCUMENTS

| | | | |
|---|---|---|---|
| 2,534,881 | 12/1950 | Schroeder | 174/84 |
| 3,117,829 | 1/1964 | Leach | 339/97 |
| 3,259,873 | 7/1966 | Parkinson et al. | 339/97 |
| 3,668,613 | 6/1972 | Klosin | 339/97 C |
| 3,899,236 | 8/1975 | Santos | 339/98 |
| 4,019,801 | 4/1977 | Hoffman | 339/98 |
| 4,036,545 | 7/1977 | Mysiak et al. . | |
| 4,132,913 | 1/1979 | Lautner et al. . | |
| 4,154,497 | 5/1979 | Donnelley et al. | 339/97 R |
| 4,252,395 | 2/1981 | Ward et al. | 339/97 P |
| 4,261,632 | 4/1981 | Narozny | 339/97 C |
| 4,312,556 | 1/1982 | Dufau | 339/99 R |
| 4,455,057 | 6/1984 | Mariani | 339/97 C |
| 4,548,459 | 10/1985 | Mosser, III . | |
| 4,730,014 | 3/1988 | Rochat et al. | 524/84 |
| 4,872,849 | 10/1989 | Long | 439/405 |
| 4,995,829 | 2/1991 | Geib et al. | 439/409 |
| 5,000,698 | 3/1991 | Kuzuno et al. . | |
| 5,030,143 | 7/1991 | Hatagishi . | |
| 5,088,934 | 2/1992 | Chow et al. . | |
| 5,154,632 | 10/1992 | Ijiri . | |
| 5,380,218 | 1/1995 | Yamamoto et al. . | |
| 5,504,654 | 4/1996 | Knox et al. . | |
| 5,514,005 | 5/1996 | Jaycox et al. | 439/417 |
| 5,709,565 | 1/1998 | Okamoto . | |

FOREIGN PATENT DOCUMENTS

| | | |
|---|---|---|
| 0 347 100 A2 | 12/1989 | European Pat. Off. . |
| 0 814 552 A1 | 12/1997 | European Pat. Off. . |
| 26 21 502 | 11/1976 | Germany . |
| 1 407 693 | 9/1975 | United Kingdom . |

OTHER PUBLICATIONS

PCT International Search Report for International Application No. PCT/US99/16931 mailed Dec. 13, 1999.

*Primary Examiner*—Renee Luebke
*Assistant Examiner*—Briggitte R. Hammond
*Attorney, Agent, or Firm*—Wallenstein & Wagner, Ltd.

[57] ABSTRACT

An efficient connector of the insulation displacement type with specific useful features for maintaining an electrical connection with an insulated conductive lead. Generally, the connector includes a terminal unitary terminal having a body portion with a leg extending therefrom. The leg has a compression side, a proximal end and a distal end. The proximal end has an arcuate portion with an aperture formed therein. The distal end has a fork with a pair of prongs defining an open slot. Formed in the compression side of the leg is a notch that, like the aperture, aids in bending and maintaining the leg in contact with an electrical lead.

14 Claims, 2 Drawing Sheets

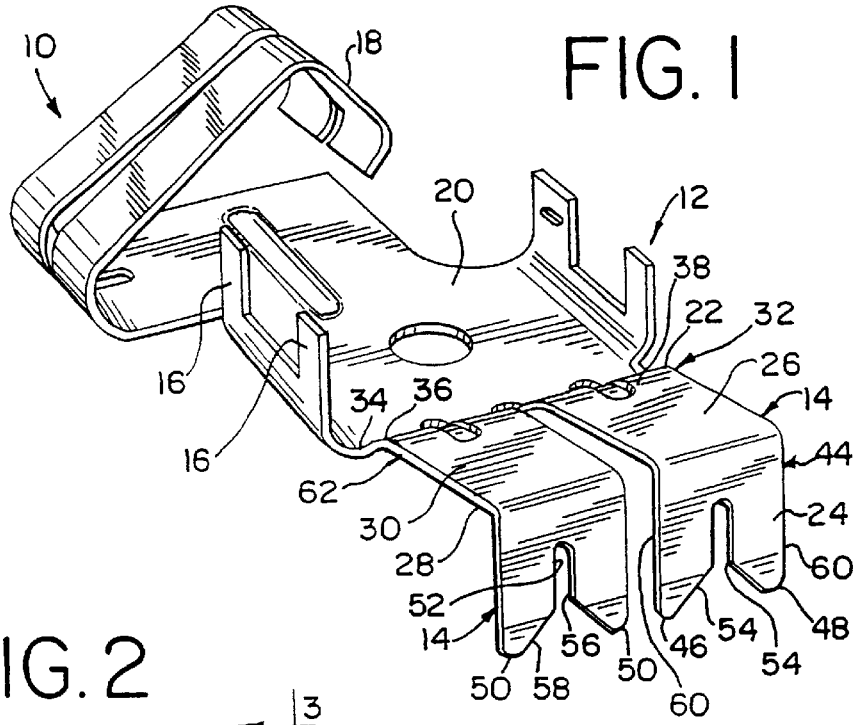
FIG. 1
FIG. 2
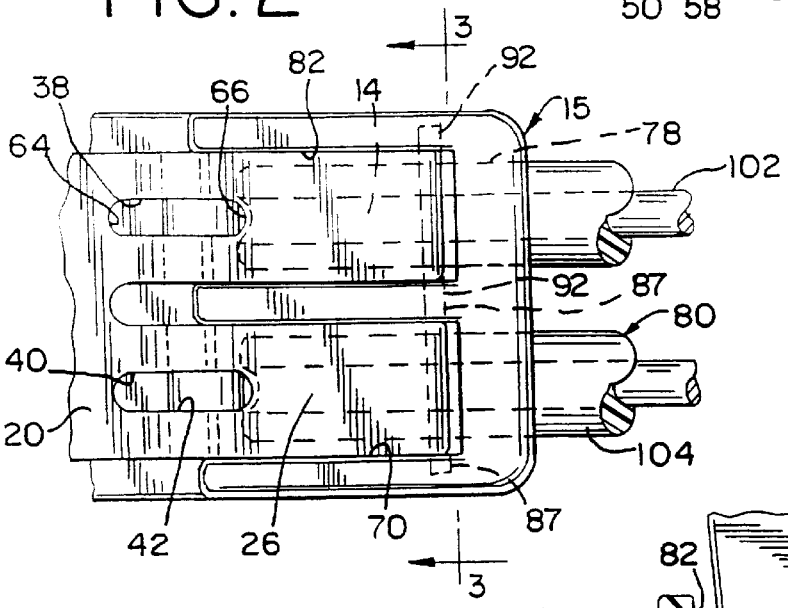
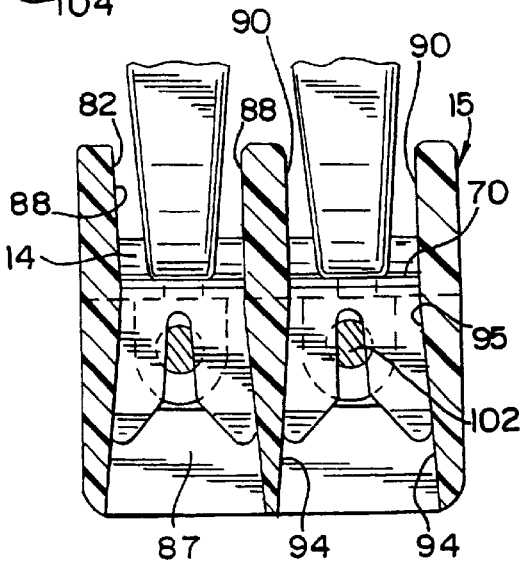
FIG. 3

INSULATION DISPLACEMENT DEVICE FOR WIRE TERMINATION

DESCRIPTION

1. Technical Field

The present invention generally relates to electrical connectors, and in particular to an electrical connector for removing the insulation from a portion of an electrical lead and maintaining an electrical connection with the electrical conductor extending within the insulation.

2. Background Art

With the ever increasing use of electrical equipment, there is a growing need for electrical connectors that efficiently and reliably terminate insulated electrical leads. Today, the technique of insulation displacement is commonly used for terminating insulated leads. This technique often incorporates a relatively sharp terminal that cuts through the insulation and makes an electrical contact with the lead.

However, many of these types of connectors that are available today fail to provide a simple means of making an electrical connection with the electrical lead without special tools. Many of these connectors include a terminal consisting of a resilient metal or metal alloy beam that partially regains its shape unless an additional locking method or fastener, such as a screw, is used to hold the terminal in contact with the lead.

Manipulating a fastener to maintain a solid electrical connection between the terminal and the lead is both time consuming and tedious. Moreover, if the fastener requires a special tool, then attempting to use any other tool to secure the fastener is impractical.

Hence, prior to the present invention, a need existed for an insulation displacement connector for electrical lead termination that quickly attaches to the lead and reliably maintains an electrical connection.

SUMMARY OF THE INVENTION

According to the present invention, an efficient connector of the insulation displacement type has been developed with specific useful features for maintaining an electrical connection with an insulated conductive lead. As a result, the connector reduces the amount of time to make a reliable electrical connection with the lead. Also, the present invention reduces the need to rely on special tools to couple the connector to the lead.

Generally, the connector of the present invention includes a unitary terminal having a body portion with at least one leg member extending therefrom. The leg member has a compression side, a proximal end and a distal end. The leg member proximal end has an arcuate portion with an aperture formed therein. The leg member has a fork with a pair of prongs defining an open slot. Formed in the compression side of the terminal is a notch that, like the aperture, aids in bending and maintaining the leg in contact with an electrical lead.

Other advantages and features of the present invention will be apparent from the following description of a specific embodiment illustrated in the accompanying drawings.

BRIEF DESCRIPTION OF DRAWINGS

FIG. 1 is an enlarged perspective view of a terminal in accordance with the present invention having a body portion with a pair of legs extending therefrom;

FIG. 2 is a fragmentary plan view of the terminal of FIG. 1 attached to a connector housing with both a portion of the legs of the terminal and two insulated electrical leads depicted in phantom;

FIG. 3 is a cross sectional view of the terminal and connector housing of FIG. 2 taken along plane 3—3 with the legs of the terminal pressed into engagement with the electrical leads;

DETAILED DESCRIPTION

Figure 4:
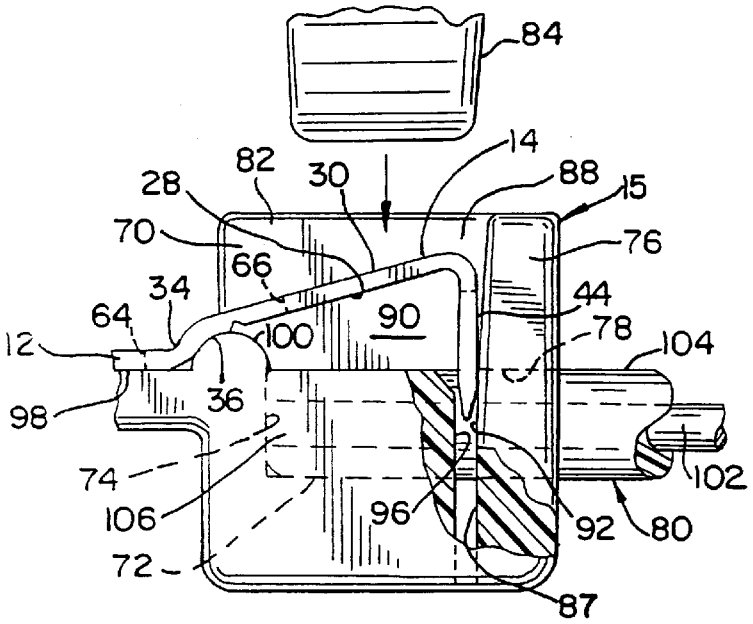
FIG. 4 is a partial fragmentary side view of the terminal and connector housing of FIG. 2.

While this invention is susceptible of embodiments in many different forms, there is shown in the drawings and will herein be described in detail a preferred embodiment of the invention. The present disclosure is to be considered as an exemplification of the principles of the invention and is not intended to limit the broad aspect of the invention to the embodiment illustrated.

Referring now to the drawings, and particularly to FIGS. 1 and 2, a connector terminal 10 is disclosed that is stamped or blanked from sheet metal stock such as a metal or metal alloy, preferably ½ hard brass, having a thickness of about 0.025 to 0.030 inches. The connector terminal 10 is of unitary construction and includes a body portion 12 having a plurality of elongated symmetrical legs 14 extending therefrom.

The body portion 12 preferably provides for securing the terminal 10 to a connector housing 15 by conventional means such as tangs 16 that cooperate with the connector housing. Further, a conventional wire attachment 18 can, if desired, extend from the body portion 12 for coupling the terminal 10 to an electrical lead (not shown).

The body portion 12 has a generally planar plate region 20. Extending from the periphery of the plate 20, in generally spaced parallel relationship with respect to each other, are the legs 14.

Each leg 14 is of unitary construction and has a proximal end 22, a distal end 24, and a substantially planar beam 26 extending between the ends. Each leg 14 also has a lower compression side 28 and an upper force application side 30.

The proximal end 22 of each leg 14 is integrally attached to plate 20 and includes an arcuate portion 32 having a concave bend 34 and a convex bend 36. Both bends 34 and 36 laterally transverse the leg 14 and are in parallel relationship to each other. Preferably, convex bend 36 is between concave bend 34 and planar beam 26.

The convex bend 36 together with the concave bend 34 elevate the leg 14 from the terminal plate region 20. The bends 34 and 36 also angle the beam 26 with respect to plate 20. Preferably, the beam 26 of each leg 14 is at an angle of about thirty (30) degrees relative to planar plate 20.

Formed in the proximal end 22 of each leg 14 is an aperture 38 having the same longitudinal plane of symmetry as the beam 26. The aperture 38 defines two generally coplanar side walls 40 and 42 in the leg 14 that face each other and extend approximately from a portion of the beam 26 to plate 20.

The distal end 24 of each leg 14 is bent such that it is generally in perpendicular spaced relationship with the plate 20 of body 17. The distal end 24 of each leg 14 has a fork 44 with a pair of prongs 46 and 48 that are substantially symmetrical with respect to each other. The terminal end 50 of each prong 46,48 preferably is tapered.

Between the prongs 46,48 of each fork 44 is a slot 52 defined by the facing edges 54 of the prongs 46,48. Within each prong pair 46,48 the facing edges 54 are substantially parallel to each other and then diverge to form a V-shaped slot opening 58. Conversely, the outer edges 60 of each prong pair 46,48 are generally parallel with respect to each other.

Formed in the planar beam 26 of each leg 14 is a score or notch 62 that is proximate to convex bend 36. Preferably, the notch 62 laterally transverses across the leg 14 and is formed in the compression side 28 of the beam 26 between the ends 64,66 of the aperture 38.

As shown in FIGS. 2–4, the terminal 10 is mounted to a connector housing 15 wherein each leg 14 is received by a separate chamber 70 in the housing. The connector housing 15 is made of a rigid electrically insulative material such as plastic or the like. Each chamber 70 of the housing 15 has a planar elongated floor 72 with a planar end wall 74 perpendicular to the floor. Opposite end wall 74 is a lead entrance wall 76 having an open passage 78 extending therethrough for receiving electrical lead 80. Moreover, another open passage 82, opposite floor 72, is provided for receiving a tool 84, such as a screwdriver or the like, to press against the force application side 30 of the leg 14. Preferably, the surface 86 of wall 76 is tapered above passages 78 such that it slants towards chamber floor 72.

The floor 72 of each chamber 70 has a lateral termination channel 87 formed therein. The channel 87 is proximate to lead entrance wall 76 and is adapted for receiving the terminal ends 50 of the pair of fork prongs 46,48 as explained in detail further herein.

Each chamber 70 also has a pair of symmetrical leg containment side walls 88 facing each other and perpendicular to end wall 74. The side walls 88 of each chamber 70 are spaced from each other with one leg 14 of the terminal received therebetween.

The surface 90 of each side wall 88 is generally coplanar with the opposing side wall within the chamber 70. Formed within each side wall 88 is a loading slot 92 proximate to the lead entrance wall 76. Each loading slot 92 has a planar inner wall surface 94 that faces the slot in the opposing wall of the chamber 70 and extends into the channel 87 in the chamber floor 72. Preferably, the inner wall surfaces 94 begin at an intermediate position 95 along each side wall 88 and are tapered to diverge from each other and the opening 78 for receiving tool 84.

Each loading slot 92 also has an intermediate wall surface 96 between the inner wall 94 and outer side wall surface 90. The intermediate wall surface 96 is planar and perpendicular to both the inner and outer wall surfaces, 94 and 90, respectively.

Elevated from the floor 72 of each chamber 70 is a planar attachment surface 98 with the body 12 of the terminal 10 positioned thereon. The terminal end 98 of the end wall 74, between planar attachment surface 98 and planar end wall surface 86, is outwardly arched to provide a laterally extending fulcrum or ridge 100.

Preferably, the compression side 28 of each leg 14, and in particular a segment of the bend 36 in the arcuate portion 32, adjoins against a portion of the ridge 100 while the prongs 46,48 of the leg 14 and slidingly adjoin against the angled surface of wall 76.

In use, an electrical connection is formed between terminal 10 and lead 80 having, for example, an elongated center conductor 102 surrounded by a cylindrical jacket 104 of electrical insulation.

Before the connection is formed, the terminal end 106 of the lead 80 is passed through passage 78 and into contact with end wall 74. As shown in FIG. 4, the fork 44 of each leg 14 is elevated above the chamber floor 72 to provide adequate space for the lead 80 to pass unobstructed between the floor and the V-shaped opening between the prongs.

Figure 5:
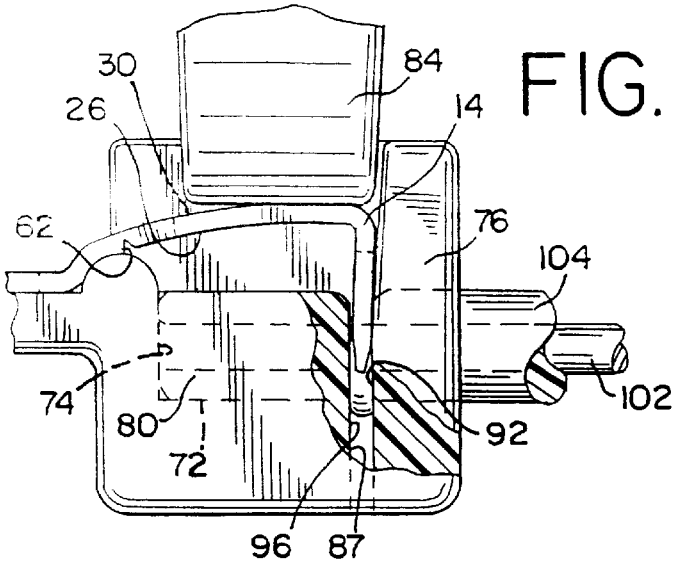
FIG. 5 is a view similar to FIG. 4 wherein one leg is partial pressed into engagement with one of the electrical leads.

As shown in FIG. 5, tool 84 is pressed against side 30 of the leg 14. The tool 84 applies force to move the beam 26 towards the chamber floor 72 wherein the lead 80 is sandwiched between the leg and the floor.

As the tool 84 presses against the leg 14, the inner edges 54 of the prongs 46,48 engage and cut into the jacket 104 of the lead 80. Also, the prong inner edges 54 engage and cut into a portion of the lead center conductor 102 to form an electrical connection therewith as depicted in FIG. 3.

Figure 6:
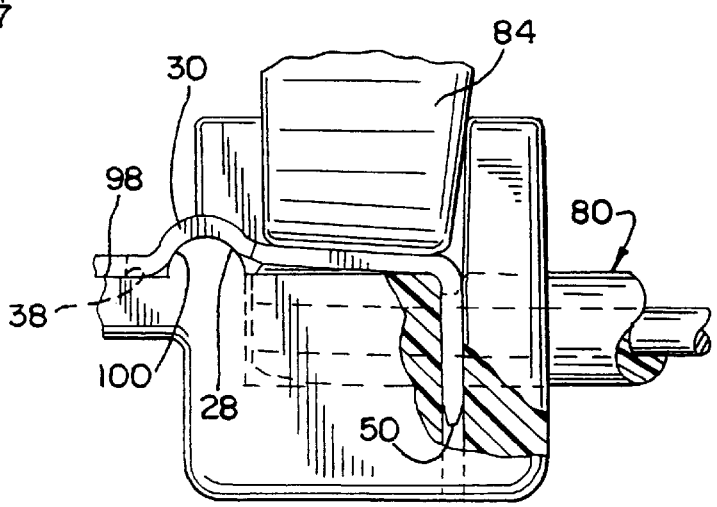
FIG. 6 is a view similar to FIG. 5 wherein the leg is completely pressed into engagement with the electrical lead.

As shown in FIGS. 4–6, as the fork 44 cuts through the insulating jacket 104, the fork is maintained generally coplanar with end wall 74 as a result of the prong outer edges 60 sliding within side wall slots 92. Further, the arcuate portion 32 of the leg 14 is deformed such that it adjoins against a substantial portion of the ridge 100.

It has been found that providing notch 62 in the compression side of the leg 14 aids in bending and maintaining the leg about ridge 100 and thus in contact with lead 80. In particular, the gap of the notch 62 shrinks to compensate for the shorter length in the compression side 28, verses opposite side 30, as the leg 14 is bent about ridge 100.

It has also been found that having aperture 38 within the arcuate portion 32 of the leg 14 facilitates in preventing the leg from partially regaining its initial shape, and thus breaking the electrical connection once force is no longer applied by tool 84. In particular, placing the aperture 38 in the leg's arcuate portion 32 reduces the amount of material, and thus resiliency, of the leg about the connector ridge 100.

As shown in FIG. 6, the travel of the leg 14 is terminated once the leg beam 26 and the chamber floor 72 both adjoin against the jacket 104 of the lead 80. Preferably, the terminal ends 50 of the prongs 46,48 are received within the channel 87 in the chamber floor 72.

Forcing the space 52 between the prongs 46,48 to receive a larger center conductor 102 results in separation between the prongs and, correspondingly, the outer edges 60 of the prongs pressing against the inner walls 88 of the connector housing 15. In such an embodiment, the fork 44 is frictionally engaged by the connector inner walls 88 resulting in the leg 14 remaining secured to the lead center conductor 80.

Further, by having the terminal ends 50 of the prongs 46,48 received in the chamber floor channel 87, the ability of the fork 44 to hold onto the lead 80 is increased. In particular, terminal ends 50 abut against the connector housing whenever an attempt is made to pull the lead 80 loose from the connector.

While the specific embodiments have been illustrated and described, numerous modifications come to mind without significantly departing from the spirit of the invention and the scope of protection is only limited by the scope of the accompanying claims.

What is claimed is:

1. An insulation displacement connector for coupling to an electrically insulated lead comprising:

a unitary terminal having a body portion with at least one leg member extending therefrom, the leg member having a compression side, a proximal end and a distal end, the compression side having a notch formed laterally transverse thereon, and across the leg member the proximal end having an arcuate portion attached to the body portion, and the distal end having a fork with a pair of prongs defining an opening.

2. The connector of claim 1 wherein the body portion includes a plate region and the leg includes a beam slanted at an angle relative to the plate region.

3. The connector of claim 2 wherein the arcuate portion includes a concave bend and a convex bend in the leg member.

4. The connector of claim 1 wherein the terminal is mounted to a housing having a chamber, the chamber is adapted to receive the leg member.

5. The connector of claim 4 wherein the housing includes a ridge adjoined by a segment of the arcuate portion.

6. The connector of claim 4 wherein the housing defines a passage in fluid communication with the chamber for receiving the lead.

7. The connector of claim 4 wherein the housing includes two side walls with the leg member therebetween, each side wall having a slot that opposes each other for receiving a corresponding outer edge of the pair of prongs, each slot having an inner wall that faces, and diverges from, the inner wall in the opposing slot.

8. The connector of claim 7 wherein the outer edges of the pair of prongs slide against the inner walls in the slots.

9. The connector of claim 7 wherein the chamber has a floor with a channel in coplanar alignment with the slots in each of the side walls.

10. A connector comprising:

a terminal having a body portion with at least one leg member extending therefrom, the leg member having a compression side, a proximal end and a distal end, the compression side having a notch formed thereon, and across the leg member the proximal end having an arcuate portion with a concave bend, a convex bend and an aperture in at least one of the bends, the distal end having a fork with a pair of prongs defining an open slot, and the notch laterally traversing the leg member proximate to the aperture; and a housing having a chamber for receiving the leg and a ridge adjoined by a segment of one of the bends in the leg member.

11. The connector of claim 10 wherein the body portion includes a plate region and the leg includes a beam slanted at an angle relative to the plate region.

12. The connector of claim 10 wherein the connector includes two opposing side walls with a slot in each side wall for receiving a corresponding outer edge of the pair of prongs, each slot having an inner wall that faces, and diverges from, the inner wall in the opposing side wall.

13. The connector of claim 12 wherein the outer edges of the pair of prongs slide against the inner walls in the slots.

14. The connector of claim 12 wherein the chamber has a floor with a channel in coplanar alignment with the slots in each of the side walls.

* * * * *